United States Patent [19]

Matsumoto et al.

[11] Patent Number: 4,870,944

[45] Date of Patent: Oct. 3, 1989

[54] AUXILIARY AIR CONTROL VALVE FOR ENGINE

[75] Inventors: Osamu Matsumoto; Hirokazu Maehara, both of Hyogo, Japan

[73] Assignee: Mitsubishi Denki Kabushiki Kaisha, Tokyo, Japan

[21] Appl. No.: 137,895

[22] Filed: Dec. 28, 1987

[30] Foreign Application Priority Data

Dec. 26, 1986 [JP] Japan ..... 61-203256[U]

[51] Int. Cl.[4] ..... F02D 9/00; F02D 41/08

[52] U.S. Cl. ..... 123/585; 123/339; 123/588

[58] Field of Search ..... 123/26, 327, 402, 585, 123/588, 339

[56] References Cited

U.S. PATENT DOCUMENTS

| | | | |
|---|---|---|---|
| 3,782,346 | 1/1974 | Tatsutomi et al. | 123/339 |
| 4,245,608 | 1/1981 | Tamaki et al. | 123/588 |
| 4,253,437 | 3/1981 | Haramoto | 123/339 |
| 4,414,943 | 11/1983 | Nagase | 123/588 |
| 4,417,553 | 11/1983 | Ohkawa et al. | 123/588 |
| 4,480,614 | 11/1984 | Kobashi et al. | 123/588 |
| 4,484,552 | 11/1984 | Kobayashi et al. | 123/588 |
| 4,630,585 | 12/1986 | Maraux | 123/585 |
| 4,690,121 | 9/1987 | Kawanabe et al. | 123/588 |
| 4,724,818 | 2/1988 | Kobayashi et al. | 123/588 |

FOREIGN PATENT DOCUMENTS

| | | | |
|---|---|---|---|
| 0038818 | 4/1978 | Japan | 123/339 |

*Primary Examiner*—Willis R. Wolfe
*Assistant Examiner*—M. Macy
*Attorney, Agent, or Firm*—Sughrue, Mion, Zinn, Macpeak & Seas

[57] ABSTRACT

An auxiliary air control valve for an engine, comprising a valve casing which has an air inlet port and an air outlet port, and a valve seat having a valve port of prescribed diameter; a valve element which is disposed in the face of the valve seat to control the cross-sectional area of the internal air passage and has a movably tapered portion fitted in the valve port to control the cross-sectional area of the internal air passage depending on the positional relation between the valve element and the valve seat, and a cylindrical portion provided next to the maximum-diameter part of the tapered portion and moved in the valve port to make the cross-sectional area of the internal air passage minimum and allow an actuator to be moved to an extreme position while the cross-sectional area is kept minimum; a spring which urges the valve element in such a direction as to open the valve; and the actuator for moving the valve element against the force of the spring, depending on at least one operational parameter of the engine.

2 Claims, 2 Drawing Sheets

AUXILIARY AIR CONTROL VALVE FOR ENGINE

BACKGROUND OF THE INVENTION

The present invention relates to an auxiliary air control valve which is used for an engine so that air is supplied to the engine in the warm-up thereof while bypassing a throttle valve.

FIG. 3 shows a sectional view of a conventional auxiliary air control valve disclosed in the Japanese Patent Application (OPI) No. 5856/84 (the term "OPI" as used herein means an "unexamined published application"). Shown in FIG. 3 is an engine 1 which is supplied with intake air through an intake passage 2 provided with bypasses 4a and 4b disposed to by-pass a throttle valve 3. A valve casing 5 has an air inlet port 6 and an air outlet port 7, which are connected to the by-passes 4a and 4b. The valve casing 5 also has a valve seat 9 provided on an internal air passage, which extends to connect the air inlet port 6 and the air outlet port 7 to each other. The valve seat 9 has a valve port 10 of prescribed minimum diameter. A valve element 20 is disposed in the face of the valve seat 9 to control the cross-sectional area of the internal air passage, and has a tapered tip portion 22. A spring 26 urges the valve element 20 in such a direction as to open the auxiliary air control valve. An actuator 14 functions to move the valve element 20 against the force of the spring 26, and contains thermowax which expands or contracts depending on the temperature of cooling water 15 from the engine 1. The actuator 14 comprises an output rod 23, which is moved in or out by the expansion or contraction of the thermowax, and a cylinder 21 for guiding the output rod.

When the temperature of the cooling water 15 for the engine 1 rises in the warm-up or the like thereof, the actuator 14 responds to the rise in the temperature so as to move the valve element 20 toward the valve seat 9 to decrease the cross-sectional area of the internal air passage to reduce the supplied quantity of auxiliary air.

When the temperature of the cooling water 15 has reached a prescribed level, the tapered tip portion 22 of the valve element 20 is tightly placed in the valve port 10 of the valve seat 9 to render the cross-sectional area of the internal air passage zero to make the supplied quantity of the auxiliary air zero. When the temperature of the cooling water 15 has exceeded the prescribed level the thermowax in the actuator 14 expands further to protrude the output rod 23. Since the output rod 23 and the valve element 20 are elastically coupled to each other, the output rod is allowed to be moved forth even if the valve element is put in contact with the valve seat 9 and therefore cannot be moved forth. A cylindrical member 24 is attached to the output rod 23 and slidably fitted on the cylinder 21. A spring 25 is provided between the cylindrical member 24 and the valve element 20 and urges the valve element in such a direction as to close the auxiliary air control valve. An engaging member 27 is provided between the valve element 20 and the output rod 23 to prevent the valve element from being uncoupled from the output rod by the spring 25.

Although the conventional auxiliary air control valve functions so as to prevent undesirable stress from being caused in the valve seat 9 through the action of the valve element 20 by the output rod 23 being protruded even after the temperature of the cooling water 15 has reached the prescribed level, the valve has problems in that the constitution of the valve is complicated, a large number of component parts are needed for the valve and the cost of production of the the valve is high.

SUMMARY OF THE INVENTION

The present invention was made in order to solve the above-mentioned problems.

Accordingly, it is an object of the present invention to provide an auxiliary air control valve which is used for an engine and has a simple construction and in which a valve element is allowed to be moved forth and the cross-sectional area of an auxiliary air passage is kept minimum even if the temperature of the cooling water of the engine has exceeded a prescribed level.

The valve element has a tapered tip portion, which is moved toward a valve seat and put into the valve port of the valve seat as the valve element is driven by an actuator responding to the temperature of the cooling water of the engine. When the temperature of the cooling water has reached the prescribed level, the maximum-diameter part of the tapered tip portion of the valve element is located in the valve port of the valve seat.

The valve element also has a cylindrical portion extending behind the tapered tip portion and having an outside diameter equal to the maximum diameter of the tapered tip portion such that the valve element is slidable on the inside circumferential surface of the valve port.

The tapered tip portion of the valve element is moved to gradually decrease the cross-sectional area of the auxiliary air passage. When the temperature of the cooling water has reached the prescribed level, the outside circumferential surface of the cylindrical portion of the valve element comes into contact with inside circumferential surface of the valve port of the valve seat to substantially close the auxiliary air passage. Even if the temperature of the cooling water has exceeded the prescribed level, the valve element can be moved forth further in the valve port of the valve seat while the valve element keeps closing the auxiliary air passage. For that reason, the valve element and an output rod can be coupled to each other in a simple manner.

DETAILED DESCRIPTION OF EXEMPLARY EMBODIMENT

An embodiment of the present invention, which is an auxiliary air control valve for an engine, is hereinafter described in detail with reference to the drawings.

Figure 1:
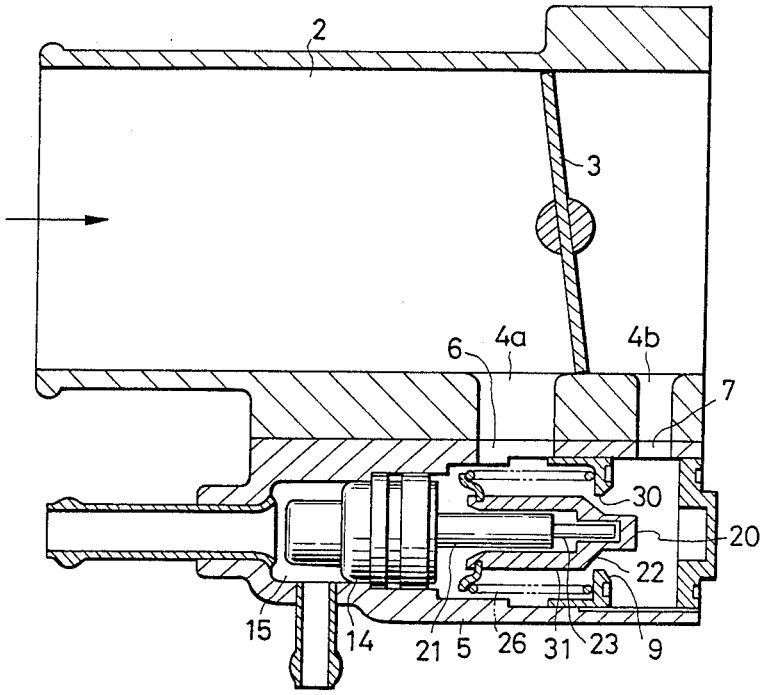
FIG. 1 shows a sectional view of an auxiliary air control valve which is an embodiment of the present invention.
Figure 2:
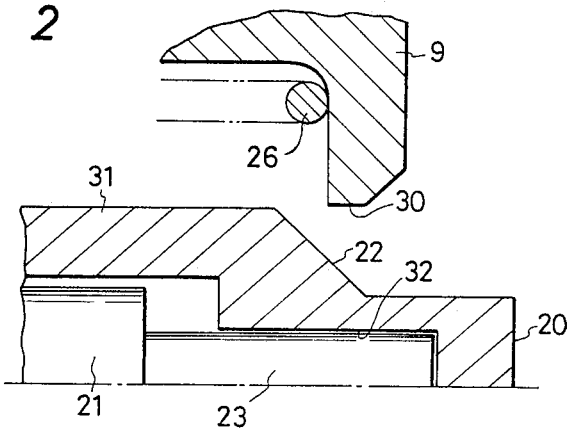
FIG. 2 shows an enlarged view of a part shown in FIG. 1.
Figure 3:
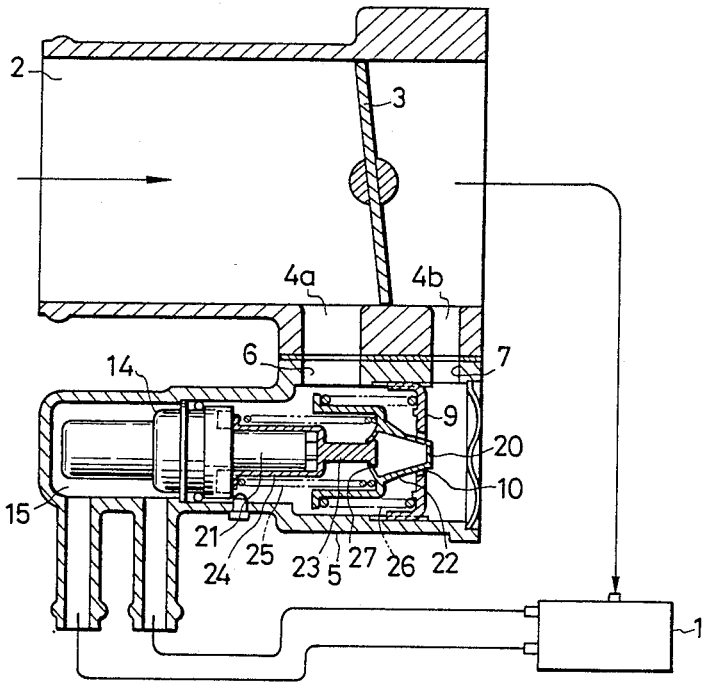
FIG. 3 PRIOR ART
FIG. 3 shows a sectional view of a conventional auxiliary air control valve for an engine.

FIG. 1 shows a sectional view of the auxiliary air control valve. FIG. 2 shows an enlarged view of a part shown in FIG. 1. The members of the auxiliary air control valve shown in FIGS. 1 and 2 are provided with the same reference symbols as the corresponding members of the conventional auxiliary air control valve shown in FIG. 3. The auxiliary air control valve shown in FIGS. 1 and 2 has a circular valve port 30, and a valve element 20 having a cylindrical portion 31 slidable in the valve port 30. The cylindrical portion 31 is fitted on a cylinder 21. The tip of an output rod 23 is inserted in the small-diameter hole 32 of the valve element 20. As a result, the valve element is guided and supported.

When the temperature of cooling water 15 rises, the actuator 14 moves the valve element 20 forth (rightward as to FIG. 1) to put the tapered portion 22 of the valve element into the valve port 30 of a valve seat 9 to decrease the cross-sectional area of an internal air passage. When the temperature of the cooling water 15 has thereafter reached a prescribes level, the maximum-diameter part of the tapered portion 22 of the valve element 20 is located in the valve port 30 to make the cross-sectional area of the internal air passage minimum (substantially zero). When the temperature of the cooling water 15 has then exceeded the prescribed level, the output rod 23 pushes the valve element 20 rightward (as to FIG. 1) further. At that time, the outside circumferential surface of the cylindrical portion 31 of the valve element 20 slides on the inside circumferential surface of the valve port 30 of the valve seat 9 so that the valve element is allowed to be moved forth further, and the output rod 23 is therefore allowed to be protruded forth further. For that reason, even after the cross-sectional area of the internal air passage is made minimum (substantially zero), the valve element 20 can be moved forth in the valve port 30 of the valve seat 9 while keeping the cross-sectional area of the internal air passage minimum (substantially zero).

As shown in FIG. 2, appropriate clearances are set between the outside circumferential surface of the cylinder 21 and the inside circumferential surface of the cylindrical portion 31 and between the outside circumferential surface of the output rod 23 and the inside circumferential surface of the small diameter hole 32, respectively, to prevent the phenomenon that the valve element 20 could not be smoothly moved back and forth in the valve port 30, due to the orientative deviation of the cylinder or the output rod from the axis of the valve port, which would result from an allowable error in the fitting of the actuator 14 in a valve casing 5.

what is claimed is:

1. An auxiliary air control valve for an engine, comprising:

an actuator;

a valve casing having an air inlet port and an air outlet port connected to bypass for bypassing the throttle valve of said engine;

a valve seat having a valve port of prescribed diameter and provided on an internal air passage extending to connect said air inlet port and said air outlet port to each other;

a valve element disposed in the face of said valve seat to control the cross-sectional area of said internal air passage in response to movement of said actuator, said valve element having a tapered portion movably fitted in said valve port to control the cross-sectional area of said internal air passage depending on the positional relation between said valve element and said valve seat, and a cylindrical portion extending from the maximum-diameter part of said taped portion such that said cylindrical portion has the same diameter as said maximum diameter part, said cylindrical portion being dimensioned so as to be slidably movable in said valve port to make the cross-sectional area of said internal air passage minimum and allow said actuator to be moved to an extreme position while said cross-sectional area is kept to a minimum in order to avoid overstressing the valve seat;

a spring which urges said valve element in such a direction as to open said valve;

wherein movement of said actuator depends on at least one operational parameter of said engine.

2. The auxiliary air control valve of claim 1, wherein said at least one operational parameter of said engine is the temperature of the cooling water of said engine.

* * * * *